US009198461B2

(12) United States Patent
Hoffmann

(10) Patent No.: US 9,198,461 B2
(45) Date of Patent: Dec. 1, 2015

(54) METHOD OF COMPENSATION OF MOMENTARY LACK OF FILTER SEGMENTS IN MULTI-SEGMENT FILTER MANUFACTURING LINE, AND DEVICE ENABLING COMPENSATION OF MOMENTARY LACK OF FILTER SEGMENTS IN MULTI-SEGMENT FILTER MANUFACTURING LINE

(75) Inventor: Hans-Reiner Hoffmann, Grevenbroich (DE)

(73) Assignee: INT'L TOBACCO MACHINERY POLAND SP. Z O.O, Radom (PL)

( * ) Notice: Subject to any disclaimer, the term of this patent is extended or adjusted under 35 U.S.C. 154(b) by 513 days.

(21) Appl. No.: 13/638,874

(22) PCT Filed: Mar. 28, 2011

(86) PCT No.: PCT/PL2011/000034

§ 371 (c)(1), (2), (4) Date: Oct. 1, 2012

(87) PCT Pub. No.: WO2011/122971

PCT Pub. Date: Oct. 6, 2011

(65) Prior Publication Data

US 2013/0029821 A1 Jan. 31, 2013

(30) Foreign Application Priority Data

Mar. 29, 2010 (PL) ..... P-390871

(51) Int. Cl.
*A24D 3/00* (2006.01)
*A24D 3/02* (2006.01)
(Continued)

(52) U.S. Cl.
CPC ..... *A24D 3/0287* (2013.01); *A24C 5/31* (2013.01); *A24C 5/478* (2013.01); *A24D 3/0295* (2013.01)

(58) Field of Classification Search
CPC ..... A24D 3/0291; A24D 3/0295; A24C 5/31; A24C 5/478; A24C 5/465
USPC ..... 493/4, 12; 198/460.1, 461.1
See application file for complete search history.

(56) References Cited

U.S. PATENT DOCUMENTS 3,357,321 A * 12/1967 Hall ..... 493/47
3,978,969 A * 9/1976 Williams et al. ..... 198/461.2
(Continued)

FOREIGN PATENT DOCUMENTS

CH 336 306 A 2/1959
DE 19 35 939 U 3/1966
(Continued)

OTHER PUBLICATIONS

International Search Report of PCT/PL2011/000034, mailing date of Oct. 27, 2011.

*Primary Examiner* — Stephen F Gerrity
*Assistant Examiner* — Patrick Fry
(74) *Attorney, Agent, or Firm* — Westerman, Hattori, Daniels & Adrian, LLP

(57) ABSTRACT

A method of compensation of momentary lack of filter segments in a manufacturing line of multi-segment filters used in tobacco industry, when an occurrence of a gap on a path feeding out sets of filter segments of a flute of a cutting drum, caused by the lack of a filter rod in the flute of the drum, the operation of units before the gap is slowed down, with simultaneous acceleration of the operation of units behind the gap, until the moment of elimination of the gap. A delivery unit having the form of a gripper holding a set of filter segments after taking it over from a out-feeding unit, a sensor detecting the lack of a filter rod in the flute of the drum is situated, in the zone of the out-feeding path for sets of filter segments at least one second sensor confirming readings of the first sensor.

10 Claims, 5 Drawing Sheets

Figure 1:
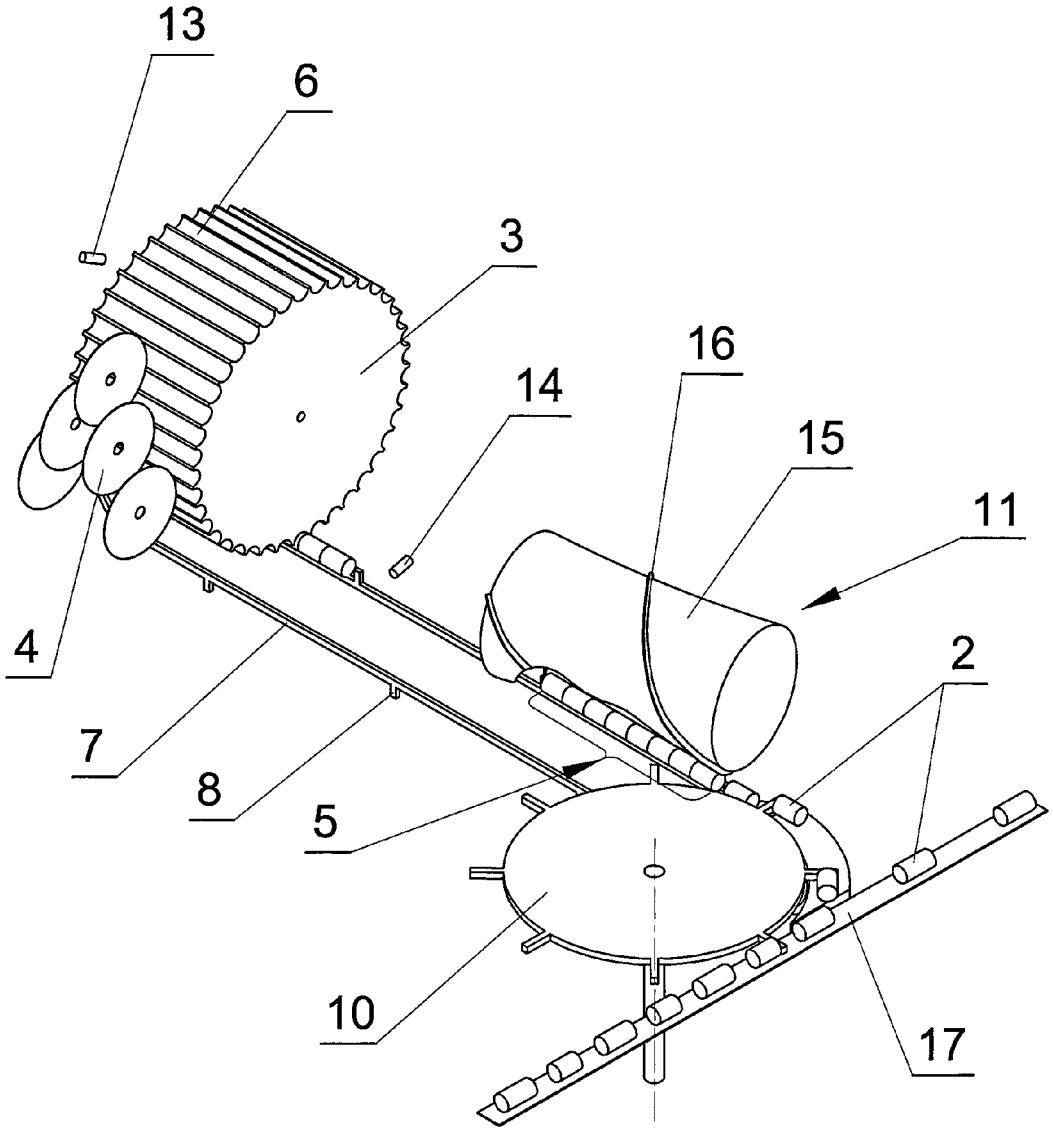

(51) Int. Cl.
*A24C 5/31* (2006.01)
*A24C 5/47* (2006.01)

(56) References Cited

U.S. PATENT DOCUMENTS 4,238,994 A 12/1980 Koch
4,287,979 A 9/1981 Molins et al.
6,540,063 B1 * 4/2003 Fallas et al. ..... 198/461.1
8,584,829 B2 * 11/2013 Cieslikowski ..... 198/460.1
2007/0117700 A1 * 5/2007 Kushihashi et al. ..... 493/39
2009/0145449 A1 * 6/2009 Cieslikowski et al. ..... 131/280
2012/0073935 A1 * 3/2012 Cieslikowski ..... 198/418

FOREIGN PATENT DOCUMENTS

GB 1 573 801 A 8/1980
WO WO 2011008113 A2 * 1/2011

* cited by examiner

METHOD OF COMPENSATION OF MOMENTARY LACK OF FILTER SEGMENTS IN MULTI-SEGMENT FILTER MANUFACTURING LINE, AND DEVICE ENABLING COMPENSATION OF MOMENTARY LACK OF FILTER SEGMENTS IN MULTI-SEGMENT FILTER MANUFACTURING LINE

The object of the invention is a method of compensation of momentary lack of the set of filter segments on a path guiding the segments in the process of manufacturing multi-segment filters used in tobacco industry for cigarettes as well as a device enabling the compensation of momentary lack of filter segments in the production line.

In the tobacco industry, there is a demand of multi-segment filters, used for the production of cigarettes which consist of at least two kinds of segments made of various filtering materials; such segments may be soft, filled, for example, with nonwoven cloth, paper, cellulose acetate, or hard, filled with granulate, sintered elements, or hollow cylinders. The created series of segments is then divided appropriately into filters used for the manufacture of cigarettes. One known method of making multi-segment filters is a line method whose operating principle has been presented several times in patent descriptions owned by the British company MOLINS Ltd. For example, British patent description No. GB 1.146.259 shows a method of manufacturing a cigarette with a filter consisting of at least three different segments, and a machine enabling the use of such method, consisting of three modules. Segments are formed by cutting filter rods with circular cutters moving peripherally on three different drums, and the cut sets of segments are removing peripherally on three different drums, and the cut sets of segments are removed from each flute of the drum with a chain conveyor provided with pushers, working always in a vertical plane inclined by a slight angle from the axis of the cutting drum. Segments are then removed by ejectors from the chain conveyor to a rotating intermediate disk mounted horizontally, whose pushers, situated on the perimeter, transfer segments endwise along the horizontal track of the grouping tape to a worm drum regulating the movement of the segments, while earlier, segments of another type obtained by cutting filter rods on drums in the other modules, are fed in a similar manner into the empty spaces between the segments onto the grouping tape. In the presented structure the intermediate disk of the central module has also pushers making additionally reciprocating motion when encountering resistance of defined strength, caused by jamming of filter segments. Such transfer is possible by using a ball clutch, which protects the pushers against damage in case of malfunction of the device. Another British patent description filed by the same company, No. GB 2.151.901 presents a device in which rods filled with tobacco are fed to the horizontal track of a grouping tape by a set of disks mounted horizontally, while the filter segments cut on the drum are inserted respectively into the empty spaces between the rods by means of rotating disks situated vertically above the tape track. In known machines designated for placing filter segments on the grouping tape, the possibility of compensating the lack of a filter rod in the flute of the drum has not been provided, which results in a gap on the path feeding out the cut sets of filter segments of the flute by means of the chain conveyor equipped with pushers. If such a gap occurs, the production is disturbed, the entire machine is switched off and a considerable number of segments fed onto the grouping tape by all modules used in the process is lost. In the abovementioned solutions there is also a risk that filters not equipped with all designed segments or cigarettes without filters are manufactured, and such incomplete products are fed to other machines for the purpose of further processing, which may result in blocking of such machines, or that they are packed. On the other hand, a method of safe transfer of filter segments to a grouping tape in the process of manufacturing multi-segment filters is known from the description of a Polish invention, application No. P-388549, wherein the said process is effected, consecutively, in the zone of delivery of the prepared segments, in the zone of separation of the delivered segments by a separating device, in the zone of intercepting of the separated segments by the transferring unit, in the zone of transferring the segments by the transferring unit and in the zone of placing the segments by the transferring unit on the horizontal path of the grouping tape. In case of incorrect flow of filter segments in any zone and/or between the zones, the process of transferring filter segments is interrupted in at least one zone, which results in stopping the filter manufacturing process. The detection of incorrect flow of filter segments may be effected by checking the resistance to motion of mechanisms by means of checking the driving torque of a motor in each zone, and comparison with the nominal torque by a control system. The said detection may also be effected by checking the change of position of the mechanisms using position sensors fixed in the transferring unit and/or in the separating device. An interruption of the process of the transfer of filter segments is effected by removal of the transferring unit and/or the separating device out of the filter segments' flow track. The removal of the transferring unit may be effected by means of an actuator moving the unit along its guide with the axis parallel to the axis of rotation of the transferring unit or by means of an actuator rotating the unit around the axis of a guide parallel to the axis of rotation of the transferring unit. In another embodiment of the method, the removal of the separating device is effected by means of an actuator moving the unit along its guide with the axis parallel to the axis of rotation of the transferring unit, and the transferring unit is removed in the opposite direction by means of an actuator along its guide with axis parallel to the axis of rotation of the transferring unit. In yet another embodiment of the method, where the separating unit and the transferring unit are mounted together on a guide, both units are removed together by means of an actuator moving the units along the guide with the axis perpendicular to the axis of rotation of the transferring unit or may be removed together by means of an actuator rotating both units together around the axis of the guide parallel to the axis of rotation of the transferring unit. The filter making process may be restarted after removing the cause of the incorrect flow of filter segments in any zone of the transfer process and/or between the zones. The presented method permits ongoing monitoring of the production process and immediate response of the control system interrupting the process in case of detection of irregularities, however, the possibility of compensating gaps in a series of segments delivered in a zone constituting a conveyor to the zone where they are separated by the separating device and transferred to the grouping tape has not been provided here either, which results in considerable production losses.

A method of compensation of momentary lack of filter segments relates to a manufacturing line of multi-segment filters, wherein filter rods are transferred from a container to flutes on a cutting drum, and then are cut into filter segments by means of cutters and fed out of the flute in form of a set of filter segments by means of pushers connected to an out-feeding unit and guided along an out-feeding path, first by the said pushers, and then by a delivery unit, to a separating device, afterwards they are transferred onto a grouping tape in order to be arranged in a series enabling to obtain the required filter of segments fed from several modules. According to the invention, in case of occurrence of a gap on the path feeding out the sets of filter segments of a flute of the cutting drum, caused by the lack of a filter rod in the flute of the said drum, the operation of the units situated before the gap, namely the delivery unit, the separating device, the transferring unit and the grouping tape is slowed down, with simultaneous acceleration of the operation of units situated behind the gap, namely the device transferring the filter rods, the cutting drum and the out-feeding unit with pushers, until the moment of elimination of the gap. The lack of a filter rod in the flute of the cutting drum is detected by means of at least one first sensor situated close to the drum, and the confirmation of the correctness of readings of the said sensor is effected by at least one second sensor situated in the zone of the path feeding out the sets of filter segments of the flute of the cutting drum. The process of compensation begins at the moment when a set of filter segments out-feeding unit situated before the gap is taken over by the delivery unit, and ends at the moment of elimination of the gap, where the set of filter segments may be taken over by means of a lug or a catch of the delivery unit. At the moment of detection of the lack of a filter rod by the sensors in one of the modules, the operation of all units in other modules is slowed down until the moment of elimination of the gap, thereafter all modules continue their operation with nominal speed. The presented method permits to eliminate the necessity of stopping the production line in case of the failure to feed a filter rod to the cutting drum in any module of the multi-segment filter manufacturing machine.

Moreover, the object of the invention is a structure of a device enabling compensation of lack of filter segments in the manufacturing line of multi-segment filters used in the tobacco industry which consists of several modules, with the device being equipped with a cutting drum with cutters situated below a container with filter rods and an out-feeding unit with pushers which feed out the cut filter segments of the flutes of the cutting drum along an out-feeding path and transfers the sets of segments to a separating device by means of a delivery unit, with the segments from individual modules being placed appropriately onto a grouping tape. According to the invention, the delivery unit has the form of a gripper holding a set of filter segments after taking them over from the out-feeding unit, and close to the cutting drum at least one first sensor detecting the lack of a filter rod in the flute of the drum is situated, while in the zone of the out-feeding path for the sets of filter segments at least one second sensor confirming the correctness of the readings of the first sensor is situated. Preferably, the delivery unit in the form of a gripper is constituted by a drum having on the surface a worm-like lug whose lead corresponds to the length of the set of filter segments, where the drum is situated above the out-feeding unit, and the axis of the drum may be twisted in relation to the line of the out-feeding path. In an alternative embodiment, the delivery unit in the form of a gripper is constituted by, an endless chain with catches whose distance to each other corresponds to the length of the set of filter segments, with the said chain being situated in such a way that its lower section constitutes an extension of the out-feeding path. In another alternative embodiment, the delivery device in the form of a gripper is made of two endless belts situated in a plane constituting an extension of the out-feeding path, at a distance to each other corresponding to the diameter of the filter segment. Such construction facilitates the use of the compensation process because the set of segments situated before the gap is removed in whole from the out-feeding path, and the clear information about this fact causes the start of the compensation.

Figures 2A, 2B, 2C:
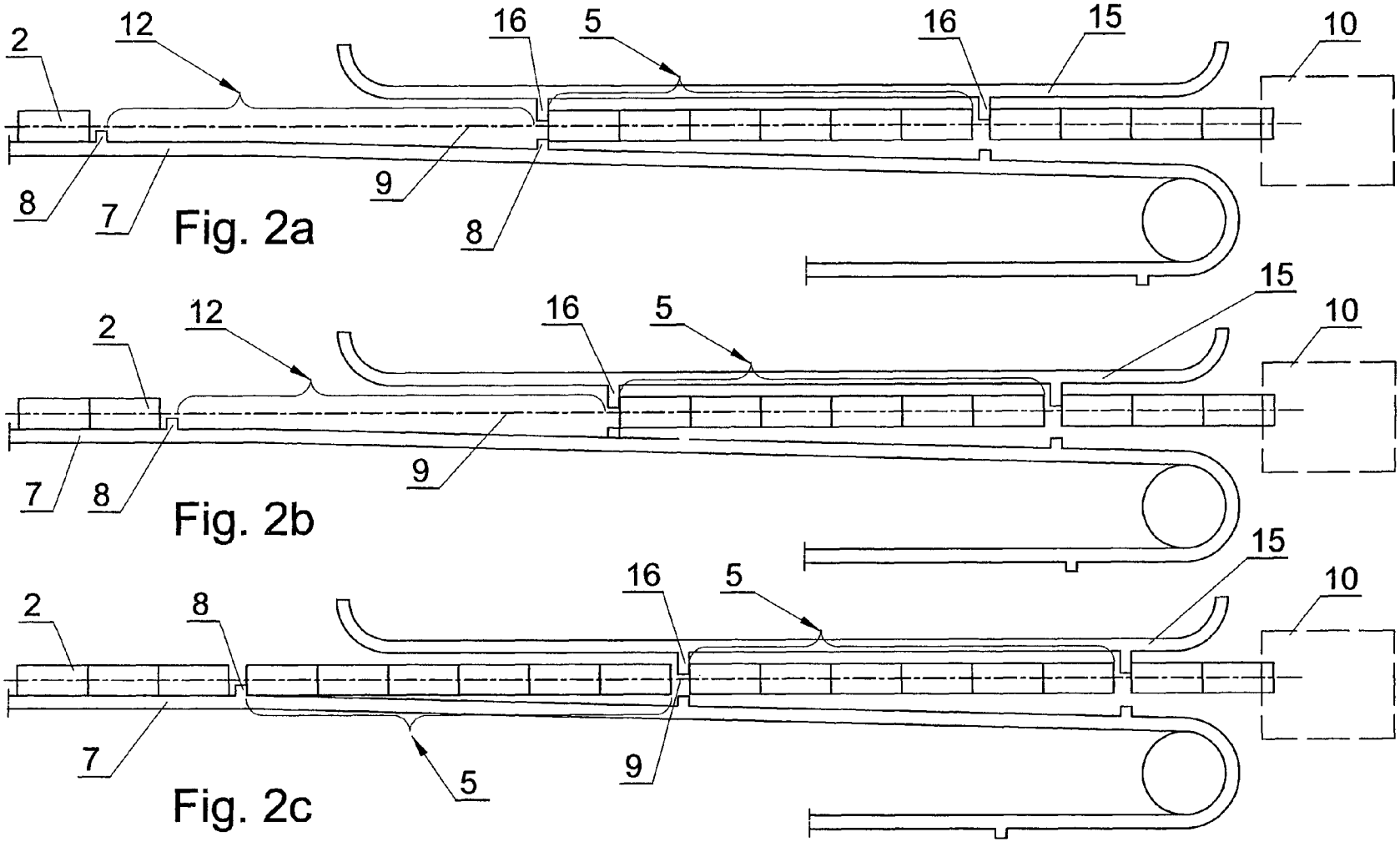
Figure 3:
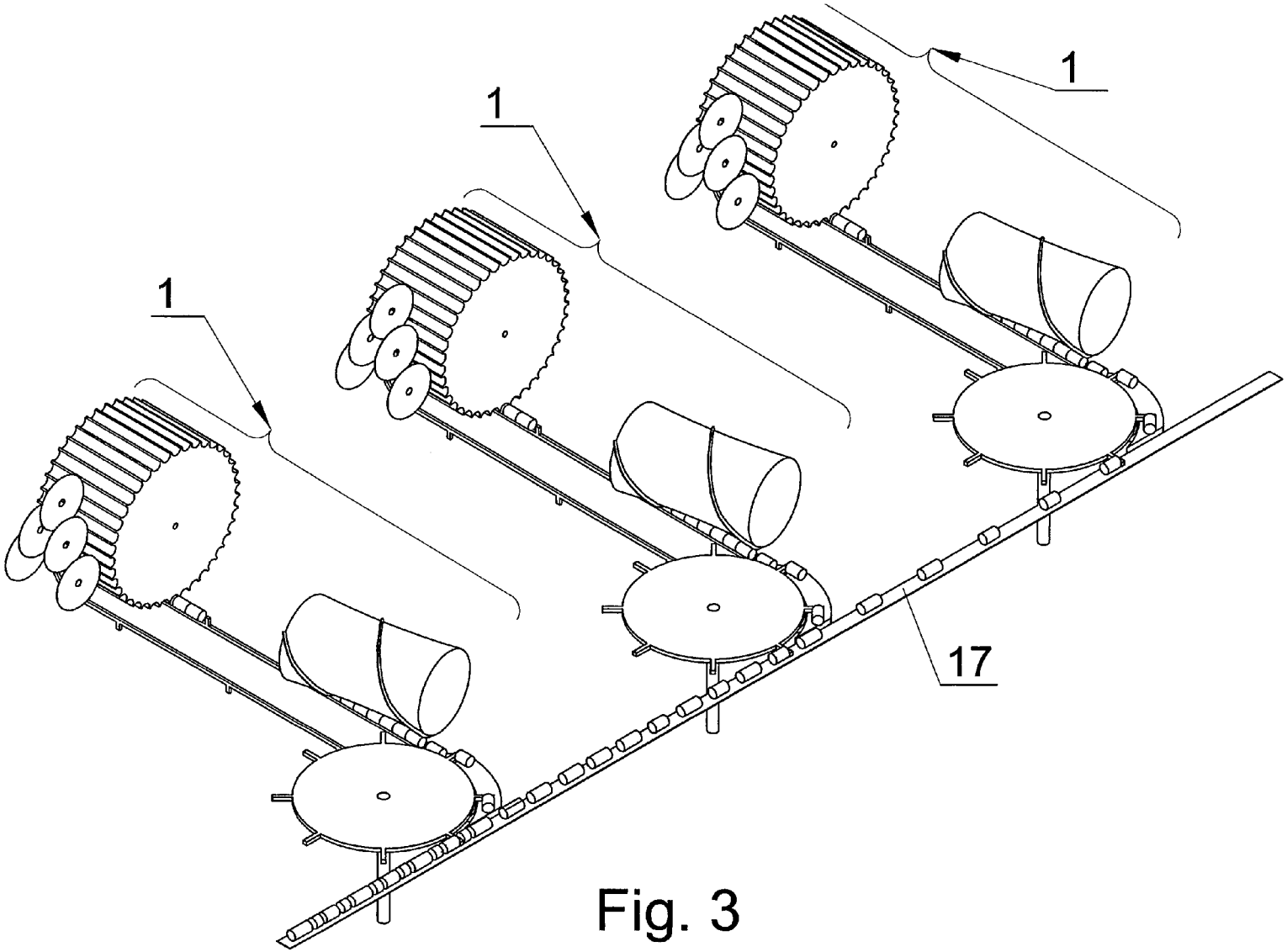
Figure 4:
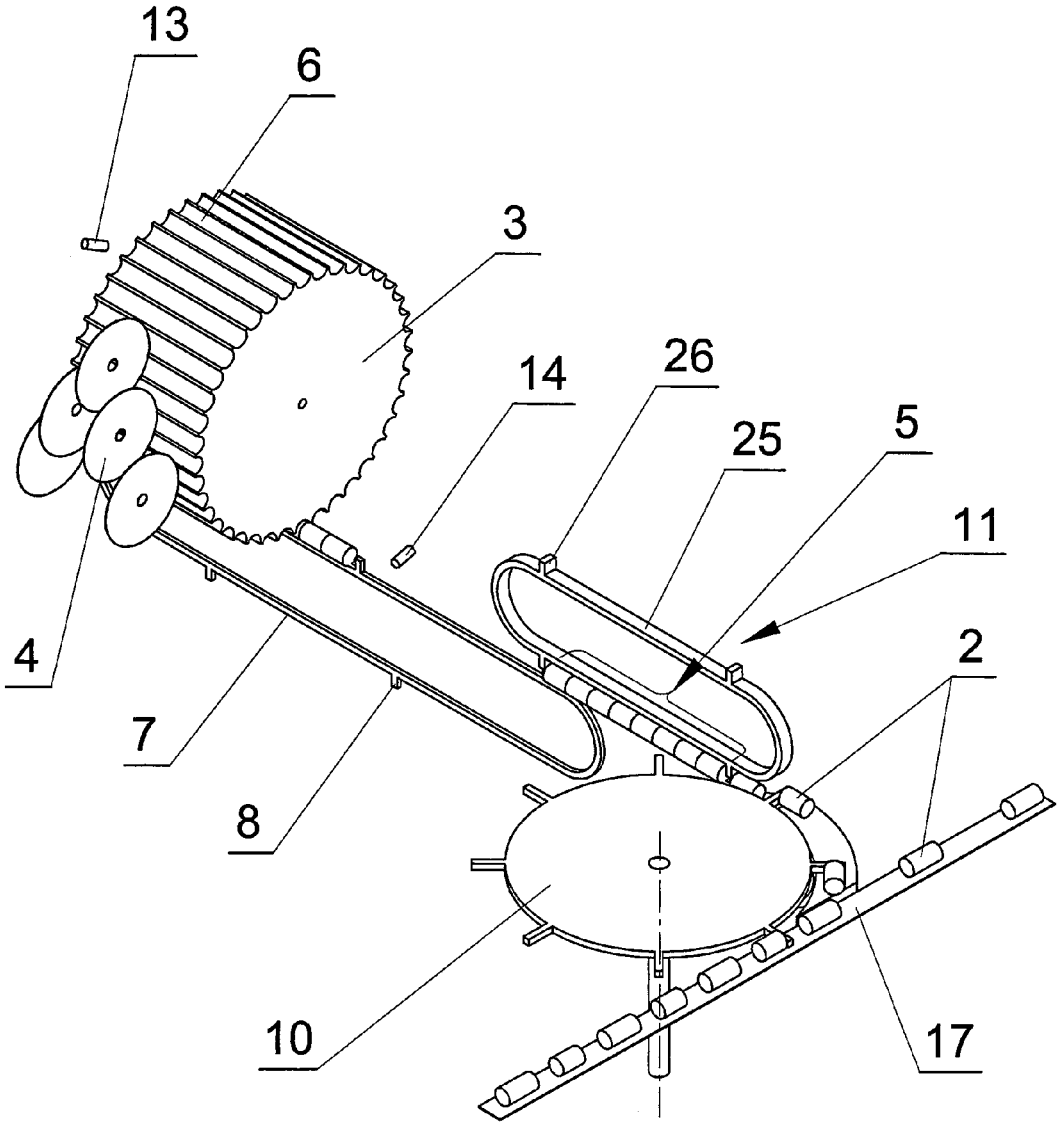
Figure 5:
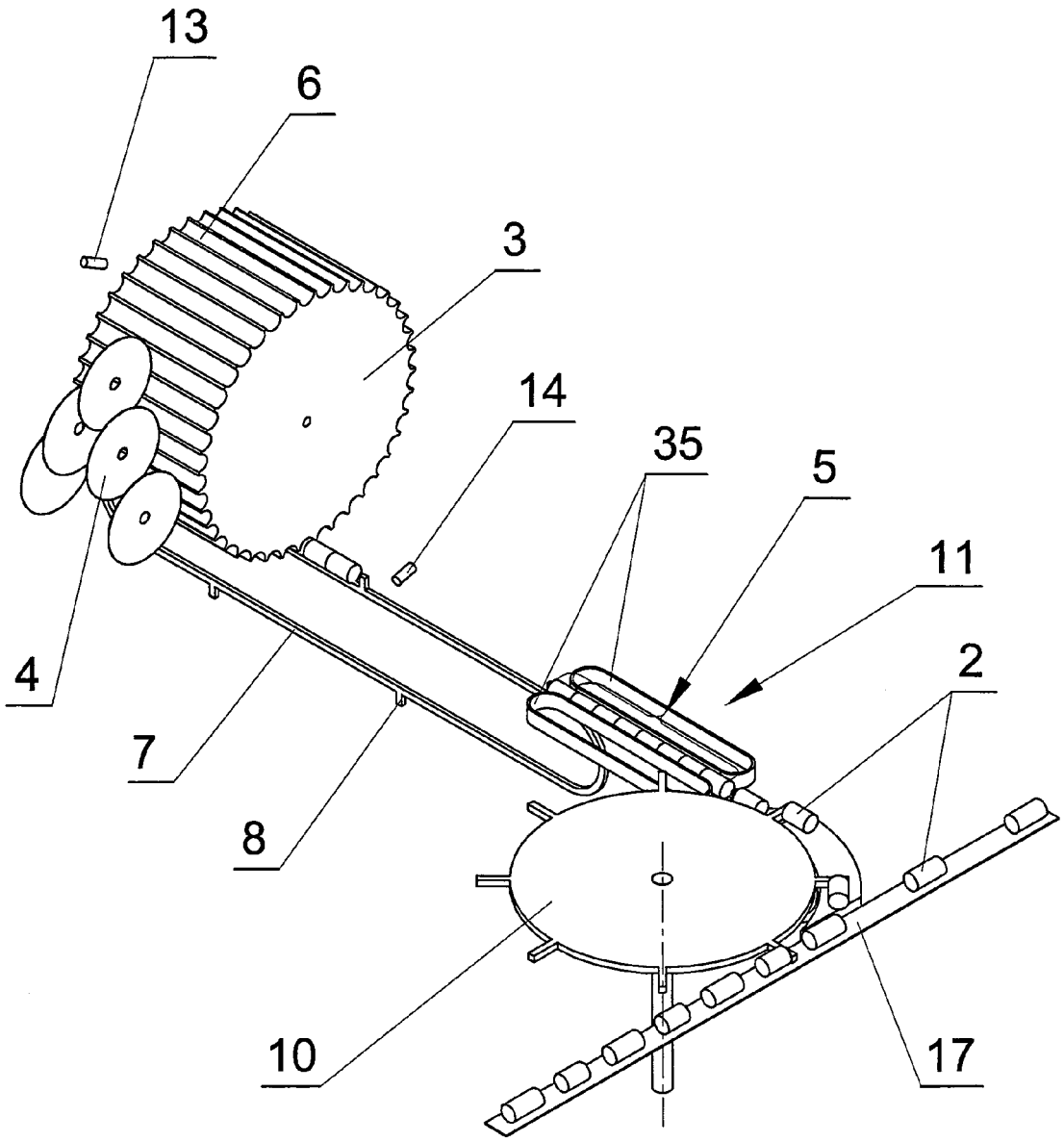

For better understanding, the object of the invention has been illustrated in embodiments in figures in which FIG. 1 shows a module of the device enabling compensation in a perspective view with the use of the delivery unit in the form of a drum with worm-like lug on the surface, FIGS. 2*a*, 2*b* and 2*c*—an enlarged fragment of the device of FIG. 1 showing subsequent phases of elimination of the gap, FIG. 3—a fragment of the production line equipped with three repeatable modules of the device enabling compensation, FIG. 4—a module of the device with alternatively used chain with catches as the delivery unit, and FIG. 5—a module of the device with alternatively used set of two belts as the delivery unit.

The device presented in the embodiment consists of three similar modules 1, which does not limit the possibility of using any number of modules 1, the number of which is determined by the content of segments 2 in a cigarette filter. The device may also include differently shaped modules 1. Each module 1 has a cutting drum 3 with cutters 4 cutting the filter rod into segments 2, situated below the filter rod container not shown in the figure. Each set of filter segments 5 is fed out of a flute 6 of a drum 3 by means of an out-feeding unit 7 in the form of a chain or a belt equipped with pushers 8 along an out-feeding path 9 and transferred to a device 10 separating segments 2 by means of a delivery unit 11 in the form of a gripper holding a set of filter segments 5 after taking them over from the out-feeding unit 7. In case of the lack of a filter rod in the flute 6 of the drum 3, on the out-feeding path 9 occurs a gap 12 between succeeding pushers 8 of the out-feeding unit 7. The lack of a filter rod in the flute 6 is signaled by a first sensor 13 situated close to the drum 3, and the confirmation of the lack of a set of segments 5 on the out-feeding path 9 is effected by the second sensor 14 situated in the zone of the out-feeding path 9. The delivery unit 11 may be constituted by the drum 15 having on the surface a worm-like lug 16, the lead of which corresponds to the length of the set of segments 5 (FIG. 1). The drum 15 is situated above the out-feeding unit 7 in such a way that the distance between the surface guiding the sets of segments 5 of the unit 7 and the jacket of the drum 15 corresponds to the diameter of the segment 2. Preferably, the axis of the drum 15 is twisted in relation to the line of the out-feeding path 9, and then the said condition of the distance of the jacket of the drum 15 and the surface of the unit 7 is fulfilled only for the side part of the drum 15. In an alternative embodiment (FIG. 4), the delivery unit 11 is constituted by an endless chain 25 with catches 26 whose distance to each other corresponds to the length of the set of filter segments 5. The delivery unit 11 in the form of the chain 25 is situated in such a way that the lower section of the chain 25 constitutes an extension of the out-feeding path 9. Alternatively, the chain 25 may be constructed as an endless belt also equipped with catches 26. In another alternative embodiment (FIG. 5), the delivery unit 11 has the form of two endless belts 35 situated in a horizontal plane constituting an extension of the out-feeding path 9, at a distance to each other corresponding to the diameter of the segment 2. The separating device 10 transfers the segments 2 to a grouping tape 17 where the segments 2 of all modules 1 are arranged in the appropriate order.

The failure to feed a filter rod from the container to the flute 6 of the cutting drum 3 results in occurrence of a gap 12 on the out-feeding path 9 between successive pushers 8 of the out-feeding unit 7 removing the sets of filter segments 5 from the flute 6. The set 5 being before the gap 12 is guided on the out-feeding path 9 by means of the pusher 8 and taken over by the lug 16 of the worm drum 15 constituting the delivery unit 11 or by the catch 26 of the endless chain 25 constituting an alternative delivery unit 11 or by two endless belts 35 constituting yet another alternative delivery unit 11. Then the segments 2 from the set 5 are transferred to the separating device 10 and further onto the grouping tape 17. At the moment of occurrence of a gap 12 on the out-feeding path 9, which has been confirmed by a second sensor 14, which has earlier compared the reading obtained from the first sensor 13, and taking over the set of filter segments 5 being before the gap 12 from the pusher 8 of the out-feeding unit 7 by the delivery unit 11, for example by the lug 16 of the worm drum 15, the operation of the units situated before the gap 12, namely the delivery unit 11, the separating device 10 and the grouping tape 17 is slowed down, with simultaneous acceleration of the operation of the units situated behind the gap 12, namely the unit transferring the filter rods from the container, the cutting drum 3 with cutters 4 and the out-feeding unit 7 with pushers 8, until the moment of elimination of the gap 12. Particular phases of the compensation have been shown in FIGS. 2*a*, 2*b* and 2*c*. After the elimination of the gap 12 all units of the apparatus operate with nominal speed. Detection of the gap 12 in one of the modules 1 causes the slowdown of operation of all units in other modules 1, until the moment of elimination of the gap 12.

The invention claimed is:

1. A method of compensation of momentary lacking of filter segments in a manufacturing line of multi-segment filters used in tobacco industry, comprising the steps of:

a) transferring filter rods from a container to flutes on a cutting drum, b) cutting the filter rods into filter segments with cutters, c) removing from one of the flutes a set of filter segments with pushers connected to an out-feeding unit and guided along an out-feeding path that is configured to feed out sets of filter segments from said flutes of the cutting drum, first by the pushers and then by a delivery unit to a separating device, d) transferring the set of filter segments from the separating device onto a grouping tape with said set of filter segments arranged in a series with required filter segments fed from several modules, and e) detecting an occurrence of a gap on said out-feeding path caused by the lack of a filter rod in the one of the flutes of the drum, and slowing down the operation of units situated downstream of the gap, while simultaneously accelerating the operation of units situated upstream of the gap, until detecting a moment of an elimination of the gap, further including in said step e), slowing down the delivery unit, the separating device, and the grouping tape, and accelerating the cutting drum with cutters and the out-feeding unit.

2. The method as in claim 1, further including in said step e), detecting a lack of a filter rod in a flute of the cutting drum with at least one first sensor situated close to the cutting drum, and confirming correctness of readings of the said sensor by at least one second sensor situated in a zone of the out-feeding path of the sets of filter segments downstream of the cutting drum.

3. The method as in claim 1 or 2, further including controlling said steps of slowing down and accelerating in said step e) to begin at a moment when a set of filter segments guided by the pusher of the out-feeding unit, being before the gap, is taken over by the delivery unit, and to end at a moment of elimination of the gap.

4. The method as in claim 3, further including delivering the set of filter segments with the delivery unit using a lug or a catch of the delivery unit.

5. The method as in claim 4, further including at a moment of detection of a lack of a filter rod by a sensor in one of the modules, an operation of all units in other modules is slowed down until the moment of elimination of the gap, after which all modules continue operation at a nominal speed.

6. A device enabling a compensation of a lack of filter segments in a manufacturing line of multi-segment filters used in tobacco industry, comprising:

a plurality of modules, each of said modules equipped with a cutting drum with cutters situated below a container with filter rods, an out-feeding unit with pushers removing cut filter segments of flutes from the cutting drum along an out-feeding path, and a delivery unit that is configured to transfer transferring sets of filter segments to a separating device that is configured to arrange segments of particular modules appropriately onto a grouping tape, wherein the delivery unit has the form of a gripper holding a set of filter segments after transfer from the out-feeding unit, at least one first sensor is situated close to the cutting drum that detects a lack of a filter rod in one of the flutes of the drum, situated in a zone of an out-feeding path of the out-feeding unit for sets of filter segments, at least one second sensor is situated that confirms the correctness of the readings of the first sensor, wherein said device is configured to detect an occurrence of a gap on said out-feeding path caused by the lack of a filter rod in the one of the flutes of the drum, and to slow down the operation of units situated downstream of the gap, while simultaneously accelerating the operation of units situated upstream of the gap, until detecting a moment of an elimination of the gap, including said device slowing down the delivery unit, the separating device, and the grouping tape and accelerating the cutting drum with cutters and the out-feeding unit.

7. The device as in claim 6, characterized wherein the delivery unit in the form of a gripper includes a drum having a worm-like lug on a surface of the drum whose lead corresponds to a length of a set of filter segments, with the drum being situated above the out-feeding unit.

8. The device as in claim 7, wherein an axis of the drum is twisted in relation to a line of the out-feeding path.

9. The device as in claim 6, wherein the delivery unit in the form of a gripper includes an endless chain with catches whose distance to each other corresponds to a length of a set of filter segments, with the endless chain of the delivery unit being situated such that a lower section of the endless chain of the delivery unit constitutes an extension of the out-feeding path.

10. The device as in claim 6, characterized wherein the delivery unit in the form of a gripper is constituted by includes two endless belts, situated in a plane constituting an extension of the out-feeding path, at a distance to each other corresponding to a diameter of the filter segments.

* * * * *